US007496208B2

(12) United States Patent
Uchimura

(10) Patent No.: US 7,496,208 B2
(45) Date of Patent: Feb. 24, 2009

(54) WIND SHIELD AND MICROPHONE

(75) Inventor: Satoshi Uchimura, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 640 days.

(21) Appl. No.: 11/141,047

(22) Filed: Jun. 1, 2005

(65) Prior Publication Data

US 2005/0271233 A1 Dec. 8, 2005

(30) Foreign Application Priority Data

Jun. 2, 2004 (JP) ..... 2004-163960

(51) Int. Cl.
*H04R 25/00* (2006.01)

(52) U.S. Cl. ..... 381/359; 381/355; 381/369; 381/189

(58) Field of Classification Search ..... 381/359, 381/355, 356, 189
See application file for complete search history.

(56) References Cited

U.S. PATENT DOCUMENTS

| | | | | |
|---|---|---|---|---|
| 3,154,171 | A * | 10/1964 | Knutson et al. | 181/158 |
| 3,548,121 | A * | 12/1970 | Wolf et al. | 381/359 |
| 4,975,966 | A * | 12/1990 | Sapiejewski | 381/189 |
| 5,444,790 | A * | 8/1995 | Kogen | 381/359 |
| 6,935,458 | B2 * | 8/2005 | Owens | 181/205 |

* cited by examiner

*Primary Examiner*—Curtis Kuntz
*Assistant Examiner*—Jasmine Pritchard
(74) *Attorney, Agent, or Firm*—Manabu Kanesaka

(57) ABSTRACT

A pop reduction filter can be properly replaced with a simple operation according to the use of a microphone. A wind shield including a shield body 20 made of an open-cell foam with a microphone insertion hole 30, the wind shield being directly put on a microphone M through the microphone insertion hole 30, the wind shield including a disk-like pop filter 40 detachably housed in the microphone insertion hole 30 so as to be orthogonal to the 0-degree direction sound pickup axis of the microphone M, the pop filter 40 being made of an open-cell foam different in foam density from the open-cell foam of the shield body 20.

4 Claims, 1 Drawing Sheet

WIND SHIELD AND MICROPHONE

RELATED APPLICATIONS

The present application is based on, and claims priority from, Japanese Application No. 2004-163960, filed Jun. 2, 2004, the disclosure of which is hereby incorporated by reference herein in its entirety.

TECHNICAL FIELD

The present invention relates to a wind shield attached to a microphone to reduce wind noise such as wind blowing sound and pop sound, and more specifically, to a wind shield capable of effectively preventing pop sound from being generated.

BACKGROUND ART

A microphone captures an incoming sound wave as a vibration of a diaphragm and converts the vibration into an electric signal. For example, when a sound is picked up outdoors, the diaphragm is vibrated by a wind and wind noise is generated. In the case of a vocal microphone, when "p" or "t" is sounded from lips, the diaphragm is strongly vibrated by a sound pressure and a pop sound is generated.

Thus, for a microphone used for picking up a sound outdoors or near a mouth, a wind shield is frequently used to reduce the occurrence of wind noise. In many cases, an open-cell foam such as a urethane foam is used for the wind shield.

There are many patterns of wind shields. As an example, Patent Document 1 (Japanese examined utility model application publication No. H01-34470) proposes a wind shield made of a single material. The wind shield is entirely formed as a single-piece construction of an open-cell foam. Further, Patent Document 2 (Japanese Patent Application Publication No. S59-146294 proposes a composite (dual) wind shield which is a combination of a first foamed resin wind shield and a second foamed resin wind shield.

In the case of the wind shield made of a single material described in Patent Document 1, an air layer formed of a notched portion is provided as a solution to pop sound. However, a certain size is necessary to obtain a practical effect, so that it is difficult to meet the need for miniaturization.

According to the composite wind shield described in Patent Document 2, it is possible to select and combine materials in consideration of the frequency response of a microphone. However, since the wind shield is entirely housed in a guard mesh (a wind shield of a wire net), a replacing operation for changing combinations of materials is difficult. In addition, the guard mesh acts as the housing case of the wind shield, and thus the wind shield cannot be applied to a microphone having no guard mesh.

SUMMARY OF THE INVENTION

An object of the present invention is to provide a composite wind shield which can be attached quite easily to a microphone, enables materials to be properly changed according to the use of the microphone, and achieves low manufacturing cost.

In order to attain the object, the present invention provides a wind shield including a shield body made of an open-cell foam with a microphone insertion hole, the wind shield being directly put on a microphone through the microphone insertion hole, the wind shield comprising a disk-like pop filter detachably housed in the microphone insertion hole so as to be orthogonal to the 0-degree direction sound pickup axis of the microphone, the pop filter being made of an open-cell foam different in foam density from the open-cell foam of the shield body. The 0-degree direction sound pickup axis of the microphone matches with the central axis of a diaphragm.

With this configuration, the pop filter is detachably mounted in the microphone insertion hole formed in the shield body, so that the pop filter can be mounted on the microphone with the shield body acting as a support. Thus, it is possible to reduce pop noise without degrading the performance of the microphone. Further, the shield body can be reduced in size.

A more preferable embodiment is that the pop filter separably includes a first pop filter having a lower density than the open-cell foam of the shield body and a second pop filter having a higher density than the open-cell foam of the shield body.

In this case, the lower density means that the number of cells (the number of bobbles) per unit length is smaller than the number of cells of the shield body. The higher density means that the number of cells (the number of bobbles) per unit length is larger than the number of cells of the shield body.

With this configuration, two kinds of high-density and low-density pop filters are provided. Thus, it is possible to easily use each of the pop filters according to the use of the microphone.

It is preferable that the first pop filter and the second pop filter be arranged in this order when viewed from the end of the microphone. With this configuration, the low-density pop filter is disposed on the side of the microphone and the high-density pop filter is disposed thereon. Thus, it is possible to effectively reduce pop noise without degrading the sound pickup characteristic of the microphone.

Further, it is preferable that the pop filter be larger in diameter than the microphone and a filter housing portion be formed with an increased diameter on the bottom of the microphone insertion hole. With this configuration, it is possible to positively prevent the pop filter from falling from the shield body. Since it is only necessary to increase the diameter of the bottom of the microphone insertion hole, the shield body can be manufactured at low cost.

The present invention also includes the microphone comprising the wind shield having these characteristics. Thus, it is possible to provide a microphone capable of changing a wind noise reduction characteristic according to a use.

DETAILED DESCRIPTION

Figure 1:
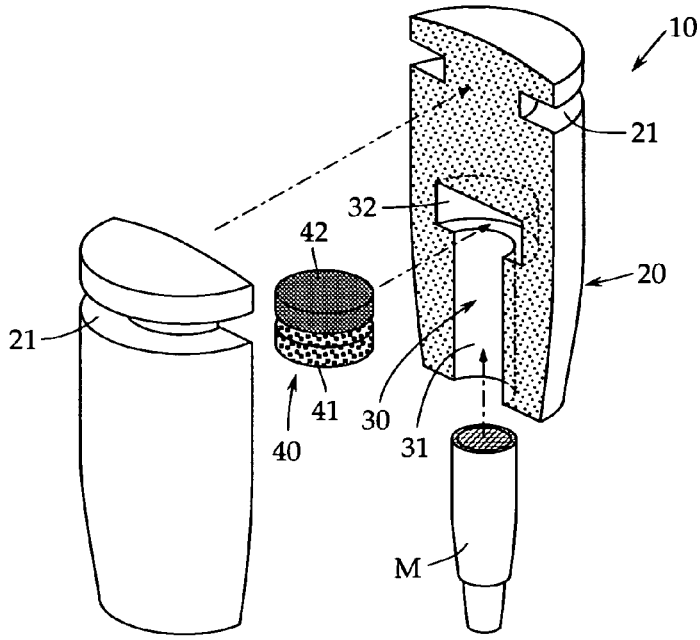
FIG. 1 is an exploded perspective view showing a wind shield according to an embodiment of the present invention.
Figure 2:
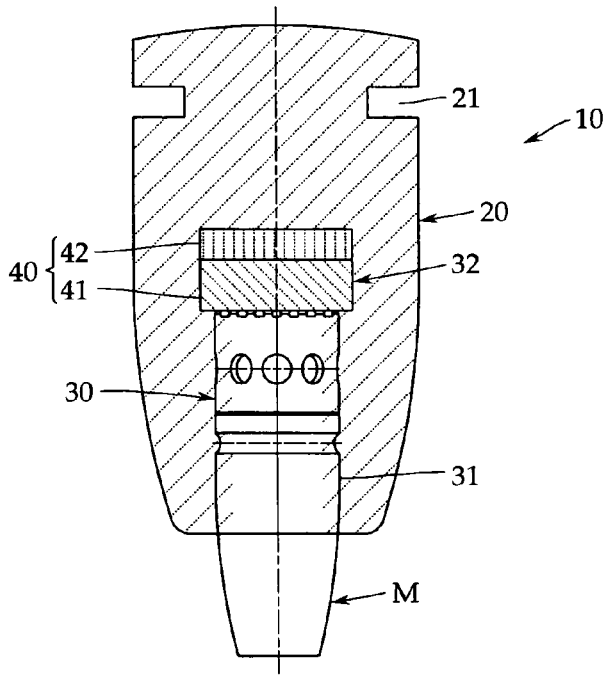
FIG. 2 is a longitudinal sectional view of the wind shield according to the embodiment.

Referring to FIGS. 1 and 2, the following will describe an embodiment of the present invention. The present invention is not limited to this embodiment. FIG. 1 is an exploded perspective view showing a wind shield of the present invention. FIG. 2 is a longitudinal sectional view showing the wind shield.

A wind shield 10 comprises a shield body 20 made of an open-cell foam such as a urethane foam. In this example, the shield body 20 is almost shaped like a cylinder. A microphone insertion hole 30 for inserting a microphone M is bored as a non-penetrating hole into the bottom of the shield body 20.

That is, the shield body 20 is directly put on the microphone M through the microphone insertion hole 30.

As in the wind shield of Patent Document 1, the shield body 20 may have a ring-shaped notched portion 21 which forms an air layer for reducing pop sound. In addition, the present invention has a pop filter 40 which is detachably housed in the microphone insertion hole 30.

For explanation, the shield body 20 is longitudinally divided at its center into two in FIG. 1. In practice, the shield body 20 may be formed as a single-piece construction. Further, the shield body 20 may be formed into a sphere. The microphone M may be any one of a condenser microphone and a dynamic microphone.

The pop filter 40 is formed into a disc and is disposed on the top (sound pickup portion) of the microphone M so as to be orthogonal to the 0-degree direction sound pickup axis of the microphone M. The 0-degree direction sound pickup axis matches with the central axis of a diaphragm (not shown) provided in the microphone M.

This example illustrates a preferred embodiment in which the pop filter 40 separably includes two filters of a first pop filter 41 and a second pop filter 42. Both of the first pop filter 41 and the second pop filter 42 are made of an open-cell foam. As compared with the open-cell foam constituting the shield body 20, the first pop filter 41 has a lower density and the second pop filter 42 has a higher density.

For example, when the open-cell foam of the shield body 20 is EVERLIGHT SF-HR50 (trade name, the number of cells per unit length of 25 mm is 47 to 53) of Bridgestone Corporation, the open-cell foam of the first pop filter 41 is a polyurethane foam of Bridgestone Corporation: EVERLIGHT SF-HR30 (the number of cells per unit length of 25 mm is 27 to 33) which has a lower density than the shield body 20.

On the other hand, the open-cell foam of the second pop filter 42 is a polyurethane foam of Bridgestone Corporation: EVERLIGHT SF-HZ80 (the number of cells per unit length of 25 mm is 70 or more) which has a higher density than the shield body 20.

It is preferable that the first pop filter 41 of low density and the second pop filter 42 of high density be arranged in this order when viewed from the microphone M.

To be specific, the first pop filter 41 of low density is disposed on the side of the microphone M and the second pop filter 42 of high density is disposed thereon, so that the sound pressure of a pop sound is greatly attenuated by the second pop filter 42 of high density and then transmitted to the microphone M through the first pop filter 41 of low density. Thus, it is possible to reduce pop noise without losing sound quality.

The outside diameter of the pop filter 40 (the first and second pop filters 41 and 42) may be almost equal to the diameter of the microphone M. In order to prevent the pop filter 40 from falling through the microphone insertion hole 30, it is preferable that the pop filter 40 be larger in diameter than the microphone M and a filter housing portion 32 of the pop filter 40 be formed with an increased diameter like a bulb on the bottom of the microphone insertion hole 30 (the top in FIGS. 1 and 2).

To be specific, the microphone insertion hole 30 comprises a microphone holding portion 31 which is firmly fit onto the microphone M so as to prevent the shield body 20 from easily falling from the microphone M. The filter housing portion 32 having a larger diameter than the microphone holding portion 31 is formed on the bottom of the microphone insertion hole 30 to house the pop filter 40. Since the pop filter 40 is made of an open-cell foam and is easily deformed, the pop filter 40 can be easily attached and detached using tweezers or like.

The present invention was described according to the illustrated example. In other examples, the pop filter 40 may be a single pop filter or may include three or more pop filters. In the case of two or more pop filters, some of them may be equal in density. The present invention also includes, for example, a stack of two or three pop filters of equal density.

The invention claimed is:

1. A wind shield including a shield body made of an open-cell foam with a microphone insertion hole, the wind shield being directly put on a microphone through the microphone insertion hole, the wind shield comprising a disk-like pop filter detachably housed in the microphone insertion hole so as to be orthogonal to a 0-degree direction sound pickup axis of the microphone, the pop filter being made of an open-cell foam different in foam density from the open-cell foam of the shield body, wherein the pop filter separably includes a first pop filter having a lower density than the open-cell foam of the shield body and a second pop filter having a higher density than the open-cell foam of the shield body.

2. The wind shield according to claim 1, wherein the first pop filter and the second pop filter are arranged in such an order that the first pop filter is situated closer to the microphone than the second pop filter is.

3. A wind shield including a shield body made of an open-cell foam with a microphone insertion hole, the wind shield being directly put on a microphone through the microphone insertion hole, the wind shield comprising a disk-like pop filter detachably housed in the microphone insertion hole so as to be orthogonal to a 0-degree direction sound pickup axis of the microphone, the pop filter being made of an open-cell foam different in foam density from the open-cell foam of the shield body, wherein the pop filter is larger in diameter than the microphone and a filter housing portion for housing the pop filter is formed with an increased diameter on a bottom of the microphone insertion hole.

4. A microphone comprising the wind shield according to claim 1.

* * * * *